US007246425B2

(12) United States Patent
Mitani

(10) Patent No.: US 7,246,425 B2
(45) Date of Patent: Jul. 24, 2007

(54) METHOD OF MANUFACTURING A SPEAKER

(75) Inventor: Shigenobu Mitani, Tamaho-machi (JP)

(73) Assignee: - Mineba Co. Ltd., Nagano-Ken (JP)

( * ) Notice: Subject to any disclaimer, the term of this patent is extended or adjusted under 35 U.S.C. 154(b) by 447 days.

(21) Appl. No.: 10/801,604

(22) Filed: Mar. 17, 2004

(65) Prior Publication Data

US 2004/0190748 A1 Sep. 30, 2004

(30) Foreign Application Priority Data

Mar. 27, 2003 (JP) ..... 2003-087406

(51) Int. Cl.
*H04R 31/00* (2006.01)

(52) U.S. Cl. ..... 29/594; 29/592.1; 29/609.1; 29/402.07; 228/115; 264/212; 264/216; 264/320; 381/407; 381/412; 381/423

(58) Field of Classification Search ..... 29/592.1, 29/594, 609.1, 402.07; 381/113, 116, 191, 381/174, 407, 412, 423; 228/181, 190, 115; 264/212, 216, 320, 323, 331.12
See application file for complete search history.

(56) References Cited

U.S. PATENT DOCUMENTS

| | | | | |
|---|---|---|---|---|
| 4,029,911 | A | 6/1977 | Albinger | |
| 4,566,178 | A * | 1/1986 | Hecht et al. | 29/594 |
| 4,825,533 | A | 5/1989 | Hayashi et al. | |
| 6,993,146 | B2 * | 1/2006 | Sato | 381/398 |
| 2003/0043728 | A1 * | 3/2003 | Kan et al. | 369/244 |

FOREIGN PATENT DOCUMENTS

| | | | |
|---|---|---|---|
| DE | 100 45 221 | A1 | 5/2001 |
| EP | 0 251 057 | A1 | 1/1988 |
| FR | 2 542 551 | | 9/1984 |
| JP | 57-13897 | | 1/1982 |
| JP | 57-13897 | A | 1/1982 |
| JP | 69-178099 | | 10/1984 |
| JP | 4-278552 | | 10/1992 |
| JP | 6-335088 | | 12/1994 |
| JP | 11-122696 | | 4/1999 |
| JP | 2000-271765 | | 10/2000 |
| JP | 2001-128286 | A | 5/2001 |
| JP | 2001-245387 | | 9/2001 |

OTHER PUBLICATIONS

Japanese Office Action issued in corresponding Japanese Patent Application No. 2003-087406 dated Feb. 27, 2007.

* cited by examiner

*Primary Examiner*—Paul D. Kim
(74) *Attorney, Agent, or Firm*—McDermott Will & Emery LLP

(57) ABSTRACT

In manufacturing a speaker, ultrasonic complex vibration welding is applied at least to: a process of fixedly putting together a magnet, a pot yoke a the pole piece; a process of fixing, to a portion of an inner circumference of a frame, an outer periphery of a spider, which has its periphery fixed to a bobbin; a process of fixing to a portion of the frame an outer circumferential edge of a surround, which has its inner circumferential edge fixed to an outer periphery of a diaphragm whose inner periphery is fixed to the bobbin; and a process of fixedly connecting both ends of each of tinsel leads respectively to terminations of a voice coil and to terminals.

2 Claims, 1 Drawing Sheet

METHOD OF MANUFACTURING A SPEAKER

BACKGROUND OF THE INVENTION

1. Field of the Invention

The present invention relates to a manufacturing method of a speaker for use in various audio equipments, and more specifically to a manufacturing method, in which main components of a speaker are welded for fixation by ultrasonic complex vibration, and also to a speaker produced by such a manufacturing method.

2. Description of the Related Art

In known methods of assembling a speaker, generally, constituent parts of a magnetic circuit are fixed to each other by means of adhesive, a frame is fixed to the magnetic circuit by means of screwing or crimping, a diaphragm is fixed to a surround by means of adhesive, and the surround is fixed to the frame by means of adhesive. Adhesive itself is very troublesome to manage, and fixation by adhesive raises various problems with respect to productivity and cost, such as variation in adhering process, difficulty in reducing curing time, and the like.

In order to solve the problems described above, a manufacturing method of a speaker is disclosed in, for example, Japanese Patent Application Laid-Open No. S57-13897. In the method disclosed, a surround is fixed to a frame by ultrasonic welding.

Another manufacturing method of a speaker is disclosed in Japanese Patent Application Laid-Open No. H11-122696. In the method, a spider is formed of a hot-cold processed woven fabric which is made of core-in-sheath type filaments each comprising a core of polyethylene terephthalate and a sheathing of polypropylene, and in which the intersecting portions of the filaments are firmly connected to each other due to the sheathing material heat-fused by the hot-cold process, and the spider thus formed is fixed by ultrasonic welding to a frame formed of resin. The spider thus structured can be produced at a lower temperature than conventionally, no special cooling system is required, and therefore existing equipments can be used as they are. And the spider structured and produced as described above is excellent in vital properties required, such as flexibility, chemical resistance, and adhesiveness.

In the first method, the material of the frame is required to be excellent in weldability with the surround so that the frame and the surround are duly fixed to each other by ultrasonic welding. And, in the second method, while it is proposed that the spider and the frame are fixed to each other by means of ultrasonic welding without using adhesive, there is no disclosure or even suggestion of the spider and frame materials which enable the spider and the frame to be duly ultrasonic-welded to each other, and also no such products as disclosed have been put to practical use.

SUMMARY OF THE INVENTION

The present invention has been made in light of the above circumstances, and it is an object of the present invention to provide a manufacturing method of a speaker, where a speaker can be produced by using a minimum amount of environmentally-unfriendly adhesive, at an ambient temperature, and at a drastically reduced cost, and to provide also a speaker which is produced in according with such a manufacturing method and which has an excellent quality.

In order to accomplish the object, according to a first aspect of the present invention, ultrasonic complex vibration welding is implemented in a manufacturing method of a speaker which basically comprises a magnetic circuit including: a magnet, pot yoke and a pole piece; a frame; a spider; a bobbin having a voice coil wound therearound; a diaphragm; a surround; terminals; and tinsel leads interconnecting the voice coil and the terminals.

Specifically, the ultrasonic complex vibration is applied to the following processes:

- a process of fixedly putting together the magnet, the pot yoke and the pole piece;
- a process of fixing, to an inner circumference of the frame, an outer circumferential edge of the spider, which has its inner periphery fixed to the bobbin;
- a process of fixing, to the frame, an outer circumferential edge of the surround, which has its inner circumferential edge fixed to an outer periphery of the diaphragm whose inner periphery is fixed to the bobbin; and
- a process of fixedly connecting both ends of each of the tinsel leads respectively to terminations of the voice coil and to the terminals.

In the first aspect of the present invention, the ultrasonic complex vibration welding may be implemented such that respective opposing inward surfaces of two components to be fixed together are brought into contact with each other and are positioned relative to each other, and then that ultrasonic vibrations oriented in different directions are simultaneously provided to the inward surfaces while a load is applied to one of the outward surfaces defined by the two components in a direction vertical to the inward surfaces.

In a second aspect of the present invention, a speaker is produced by the manufacturing method in accordance with the first aspect.

Since a speaker is produced by using the ultrasonic complex vibration welding to some particular processes of fixing major components instead of using adhesive, the assembly and production is accomplished under a clean circumstance at an ambient temperature, therefore eliminating thermal influence, and in good condition, whereby the productivity is significantly enhanced while maintaining a consistent and good quality. Also, since the ultrasonic complex vibration welding achieves a firm connection without thermal influence, the components welded do not suffer degradation thus providing a reliable product with a good quality.

BRIEF DESCRIPTION OF THE DRAWING

The above object and other advantages of the present invention will become more apparent by describing in detail the preferred embodiment of the present invention with reference to the attached drawing, in which.

DETAILED DESCRIPTION OF THE PREFERRED EMBODIMENT

Figure 1:
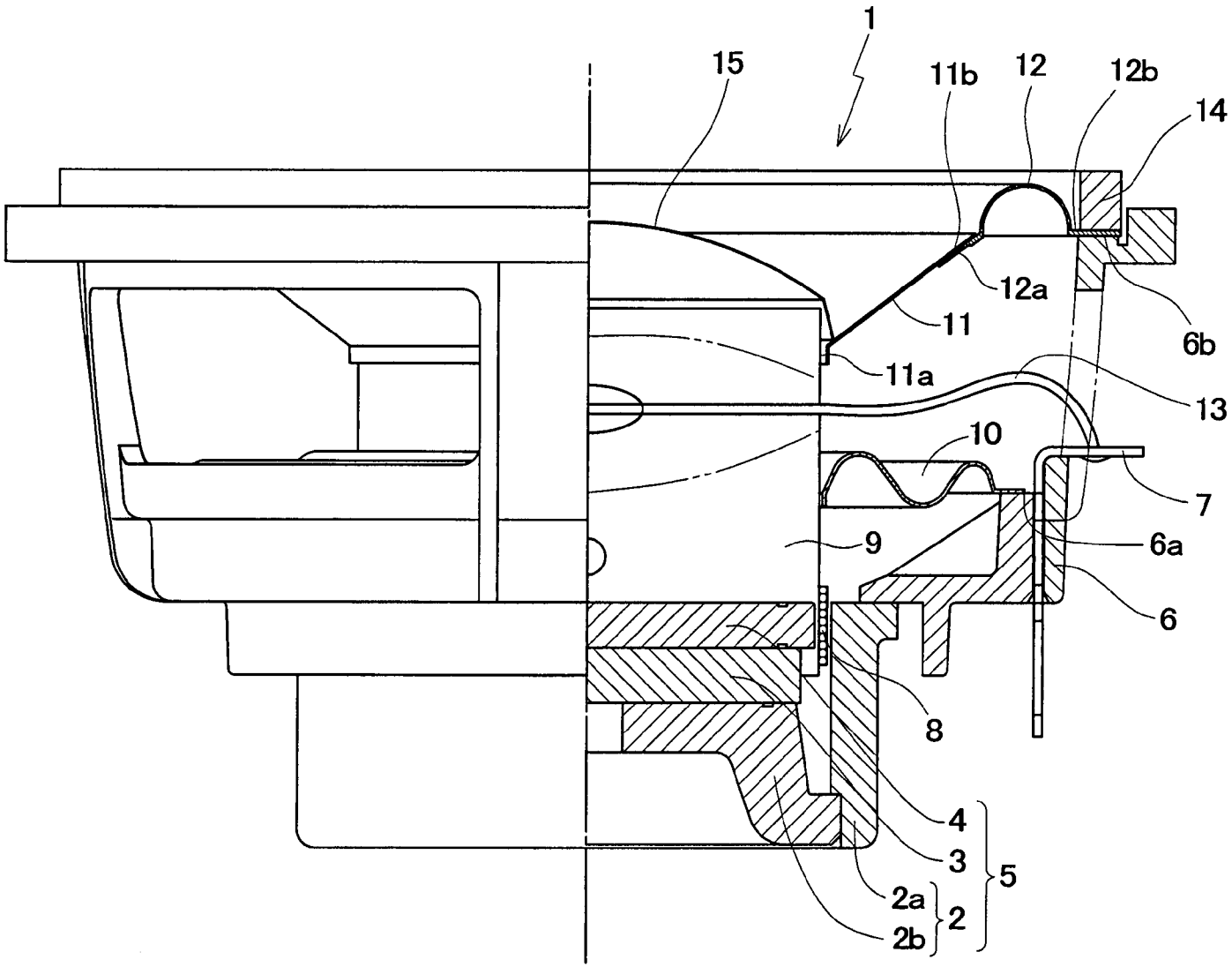
FIG. 1 is partially a cross-sectional elevation vie view of a speaker produced to a manufacturing method according to the present invention.

A preferred embodiment of the present invention will hereinafter be described with reference to FIG. 1.

Referring to FIG. 1, a speaker 1 generally comprises: a magnetic circuit 5 including a pot yoke 2 consisting of a cylindrical wall section 2*a* and a base section 2*b*, a magnet 3, and pole piece 4; a frame 6 formed of resin and attached at an upper opening portion of the pot yoke 2; terminals 7 secured to an outer circumference of the frame 6; a tubular bobbin 9 having a voice coil 8 wound therearound; a spider 10 formed of resin-impregnated fabric, having its inner periphery fixedly connected to a middle portion of an outer circumference of the bobbin 9, and having its outer periphery fixedly attached to a spider attachment region 6*a* formed at a portion of an inner circumference of the frame 6; a diaphragm 11 having an inner periphery 11*a* thereof fixedly connected to a top portion of the outer circumference of the bobbin 9; a surround 12 formed of resin, having an inner circumferential edge 12*a* thereof fixed to an outer periphery 11*b* of the diaphragm 11, and having an outer circumferential edge 12*b* thereof fixedly attached to a surround attachment region 6*b* formed at a top portion of the frame 6; and tinsel leads 13 electrically connecting terminations of the voice coil 8 to the terminals 7.

The magnet 3 is made either of cast metal, such as alnico, iron chrome, and the like, or of plated metal, such as neodymium. The speaker 1 further includes a gasket 14 sitting fixedly on an upper side of the outer circumferential edge 12*b* of the surround 12, and a dust cap 15 to cover up a top opening of the bobbin 9.

The speaker 1 structured as described above is assembled in a manufacturing method described below.

In forming the magnetic circuit 5, the magnet 3 and the pole piece 4 are welded together by ultrasonic complex vibration, and the magnet 3 and the pot yoke 2 are welded together by ultrasonic complex vibration via aluminum foil (not shown) interposed therebetween. In this connection, the magnet 3 and the pot yoke 2 can practically be welded together directly without aluminum foil therebetween, though the welding strength decreases a little. The magnet circuit 5 shown in FIG. 1 is an inner magnet type, but may alternatively be an outer magnet type.

Both terminations of the voice coil 8 are weldedly connected to respective one ends of the tinsel leads 13 by ultrasonic complex vibration, and the welded connections are adhesively fixed to the bobbin 9. The bobbin 9 with the voice coil 8 thus processed is put inside the magnetic circuit 5 by using a jig so that the voice coil 8 is positioned between the pole piece 4 and the cylindrical wall section 2*a* of the pot yoke 2. In this connection, the bobbin 9 should preferably have its outer circumference fixedly connected to the inner periphery of the spider 10 beforehand, in which case the outer periphery of the spider 10 is fixed to the spider attachment portion 6*a* of the frame 6 by ultrasonic complex vibration while the bobbin 9 is held in place by the jig as described above.

The diaphragm 11, which has its outer periphery 11*b* fixed to the inner circumferential edge 12*a* of the surround 12 beforehand, has its inner periphery 11*a* adhesively fixed to the top portion of the outer circumference of the bobbin 9, and then the outer circumferential edge 12*b* of the surround 12 is fixed to the diaphragm attachment portion 6*b* of the frame 6 by ultrasonic complex vibration.

The other ends of the tinsel leads 13 are weldedly connected to the terminals 7 by ultrasonic complex vibration, the gasket 14 is adhesively attached to the upper side of the outer circumference edge 12*b* of the surround 12, and the dust cap 15 is put so as to cover up the top opening of the bobbin 9. Thus, the speaker 1 is completed.

In the process of assembling the speaker 1, the welding work by ultrasonic complex vibration may be implemented in several ways. For example, when welding the magnet 3 and the pole piece 4, the magnet 3 is first placed on an anvil, the pole piece 4 is then put on the magnet 3 and appropriately positioned, a welding head (not shown) is applied onto the pole piece 4, a pair of Langevin type transducers (not shown) are driven with an appropriate amount of load applied thereby causing ultrasonic complex vibration at the welding head, the ultrasonic complex vibration caused is transferred via a horn (not shown) to contact surfaces of the magnet 3 and the pole piece 4, and the welding head and the contact surfaces are moved relative to each other in different directions for fusing the contact surfaces entirely. Such a process is implemented at an ambient temperature.

Consequently, the magnet 3 and pole piece 4 can be connected to each other in a very short time without undergoing thermal shock, and in good condition. Contaminants on the welding surface of the magnet 3 or the pole piece 4, if any, are dissipated by ultrasonic vibration, thus enabling a reliable and uniform welding with less energy.

Many different embodiments of the present invention may be constructed without departing from the spirit and scope of the invention, and it should be understood that the present invention is not limited to the specific embodiments described in this specification. The present invention is intended to cover various modifications and equivalent arrangements included within the spirit and scope of the appended claims.

What is claimed is:

1. A manufacturing method of a speaker comprising; a magnetic circuit including a magnet, pot yoke and a pole piece; a frame; a spider; a bobbin having a voice coil wound therearound; a diaphragm; a surround; terminals; and tinsel leads interconnecting the voice coil and the terminals, wherein ultrasonic complex vibration welding is applied to:

a process of fixedly putting together the magnet, the pot yoke and the pole piece;

a process of fixing, to an inner circumference of the frame, an outer periphery of the spider, the spider having an inner periphery fixed to the bobbin;

a process of fixing, to the frame, an outer circumferential edge of the surround, which has its inner circumferential edge fixed to an outer periphery of the diaphragm whose inner periphery is fixed to the bobbin; and a process of fixedly connecting both ends of each of the tinsel leads respectively to terminations of the voice coil and to the terminals.

2. A manufacturing method according to claim 1, wherein the ultrasonic complex vibration welding is implemented such that respective opposing inward surfaces of two components to be fixed together are brought into contact with each other and positioned relative to each other, and then that ultrasonic vibrations oriented in different directions are simultaneously provided to the inward surfaces while a load is applied to one of outward surfaces defined by the two components in a direction vertical to the inward surfaces.

* * * * *

UNITED STATES PATENT AND TRADEMARK OFFICE

CERTIFICATE OF CORRECTION

PATENT NO. : 7,246,425 B2
APPLICATION NO. : 10/801604
DATED : July 24, 2007
INVENTOR(S) : Shigenobu Mitani It is certified that error appears in the above-identified patent and that said Letters Patent is hereby corrected as shown below:

On the Title page

Under section "(73) Assignee", change "Mineba Co., Ltd., Nagano-Ken (JP)" to -- Minebea Co., Ltd., Nagano-Ken (JP) --.

Signed and Sealed this

Twelfth Day of August, 2008

JON W. DUDAS
*Director of the United States Patent and Trademark Office*